US005711125A

United States Patent [19]

Schooling

[11] Patent Number: 5,711,125

[45] Date of Patent: Jan. 27, 1998

[54] STORAGE BUILDING DOOR

[76] Inventor: John Schooling, 278 Main St., Wadsworth, Ohio 44281

[21] Appl. No.: 645,342

[22] Filed: May 13, 1996

Related U.S. Application Data

[62] Division of Ser. No. 4,235, Jan. 29, 1993, Pat. No. Des. 372,103.

[51] Int. Cl.[6] ..... E06B 3/74

[52] U.S. Cl. ..... 52/457; 52/211; 52/311.2; 52/314; 52/455; 52/762; 52/800.1; 52/801.1; 52/807.12

[58] Field of Search ..... 52/211, 311.2, 52/314, 380, 762, 763, 800.1, 801.1, 801.11, 801.12, 455, 457

[56] References Cited

U.S. PATENT DOCUMENTS

| | | | |
|---|---|---|---|
| 1,635,466 | 7/1927 | De Penning | 52/801.12 X |
| 1,767,569 | 6/1930 | Andersen | 52/97 |
| 3,100,320 | 8/1963 | Frederick | 52/211 |
| 3,139,703 | 7/1964 | Hilt | 52/211 X |
| 3,811,238 | 5/1974 | Brinker | 52/211 |

*Primary Examiner*—Christopher Kent
*Attorney, Agent, or Firm*—Ralph E. Jocke; David R. Percio

[57] ABSTRACT

A wood door system (10) provides enhanced weather durability for use on outdoor wooden storage buildings. The door system includes trim (30) and one or more movable doors (40). Wood trim members (32, 34) cover a gap between the exterior wall of the wooden storage building. Movable door members (40) are operably attached to the wooden storage building. Bracing members (42, 44, 46) are attached to movable door members (40) to strengthen said movable door members. Wood trim members (32, 34) and bracing members (42, 44, 46) also provide a decorative feature for the wood doors system (10). The wood trim member (32) and the bracing members (42, 44, 46) have an upper surface tapered outwardly and downwardly from the wooden storage building wall to prevent precipitation and contamination from collection on said upper surfaces. Such shedding of precipitation serves to wash any airborne contaminants from said surfaces.

15 Claims, 3 Drawing Sheets

STORAGE BUILDING DOOR

This application is a divisional application of application Ser. No. 29/004,235 filed Jan. 29, 1993 now Design Pat. No. 372,103.

TECHNICAL FIELD

This invention relates to door systems. Specifically this invention relates to wood door systems used on outdoor storage buildings which provide improved weather resistance and an attractive appearance.

BACKGROUND ART

Storage buildings are used in a variety of industrial, commercial and residential applications. Utility and economy are important considerations in the selection of a storage building. Many commercial and residential applications also include an aesthetic consideration. Application of decorative features to the door system has been a common way to improve the appearance of a storage building.

Door systems for wooden storage buildings are commonly made of wood to match the exterior walls of the wooden storage building. Wood doors require reinforcement to provide strength that is comparable to the strength of the walls of the wooden storage building and for structural integrity and security. This reinforcement can be provided by metal braces or by wood braces.

A drawback associated with metal braces is that they do not match the appearance of the wooden storage building walls. To maintain the uniform wood exterior appearance of the storage building the metal braces must be located on the interior side of the door. Braces placed on the interior side of the door do not provide a decorative feature. Further, when the door is open the metal door bracing is visible. Further drawbacks of metal braces include the need for additional metalworking tools when constructing the wooden storage building and higher cost of material than for wood braces.

Wood braces placed on the exterior side of the door to provide a decorative feature have members with surfaces arranged both vertically and horizontally disposed to the ground. A drawback associated with the horizontal surfaces is that moisture and contamination accumulates on them. This problem is particularly common where precipitation is heavy and frequent, where alternating freezes and thaws are common, and where air contaminants are present. This exposure to outdoor elements can cause deterioration of any protective coating on the wood and the wood itself over time. By locating the wood braces on the interior side of the door they are protected from the outdoor elements, but they cannot provide any decorative feature.

Wood trim is placed on the door frame to cover spaces between the door frame and the wooden storage building wall. The wood trim improves the weather tightness and provides a decorative feature on the exterior of the wooden storage building. Wood trim placed on the exterior side of the frame also experiences deterioration caused by accumulation of moisture and contamination.

Thus there exists a need for a wood door system which includes wood braces on its exterior surface to provide added strength, which minimizes damage due to moisture and contamination penetration, and which provides a decorative feature for an attractive appearance.

DISCLOSURE OF INVENTION

It is an object of the present invention to provide a wood door system for outdoor wooden storage buildings.

It is a further object of the present invention to provide a wood door system that has wood trim.

It is a further object of the present invention to provide a wood door system that has wood trim.

It is a further object of the present invention to provide a wood door system that has decorative wood braces on the exterior surface of the door.

Further objects of the present invention will be made apparent in the following Best Mode For Carrying Out Invention and the appended claims.

The foregoing objects are accomplished in a preferred embodiment of the invention by a door system for a storage building with wood, and wood trim on the exterior surface of the door.

The door system surrounds an opening in an outside wall of the storage building. The opening may be any shape, but most often is rectangular. Wood trim provides weather protection by reducing the potential for rain, snow, wind and other elements from reaching the interior of the wooden storage building. This wood trim also provides a decorative feature surrounding the area of the opening.

The wood trim is comprised of one or more trim elements. The elements or portions thereof are disposed upwardly above the ground or other supporting surface for the storage building. Additional elements or portions thereof are disposed generally horizontally above the opening in the wall of the storage building. The horizontal elements or portions include uppermost or top surfaces. Such top surfaces are tapered outwardly and downwardly relative to the outside wall of the building. As a result moisture from rain or snow is urged to fall off the top surfaces. Also airborne contaminants which come to rest on the top surfaces tend to fall off with any accumulated moisture. This avoids the formation of acids and other compounds that can attack the elements or the coatings thereon.

The door system further includes a door. The door may be attached by hinges which enable rotation about a fixed hinge point, by a track or channel which enables the door to slide directly in the track or channel or on rollers attached to the door, or by any other suitable means. In its closed position the door prevents access to and from an interior area of the storage building. In its open position the door permits access to and from the interior area.

The door includes a door surface with wood braces that extend outward therefrom. The wood braces comprise door elements. The door elements or portions thereof extend vertically above the ground or supporting surface. The door elements or portions thereof include uppermost or top surfaces. The top surfaces extend generally outwardly and downwardly with respect to said door surface. Moisture and contaminants are urged to fall from said door elements in a manner similar to the trim elements.

The present invention enables a wood door system to be reinforced with wood braces and trimmed with wood trim on its exterior surface. The wood braces and wood trim further provide a decorative appearance while shedding moisture and contaminants.

BEST MODE FOR CARRYING OUT INVENTION

Figure 1:
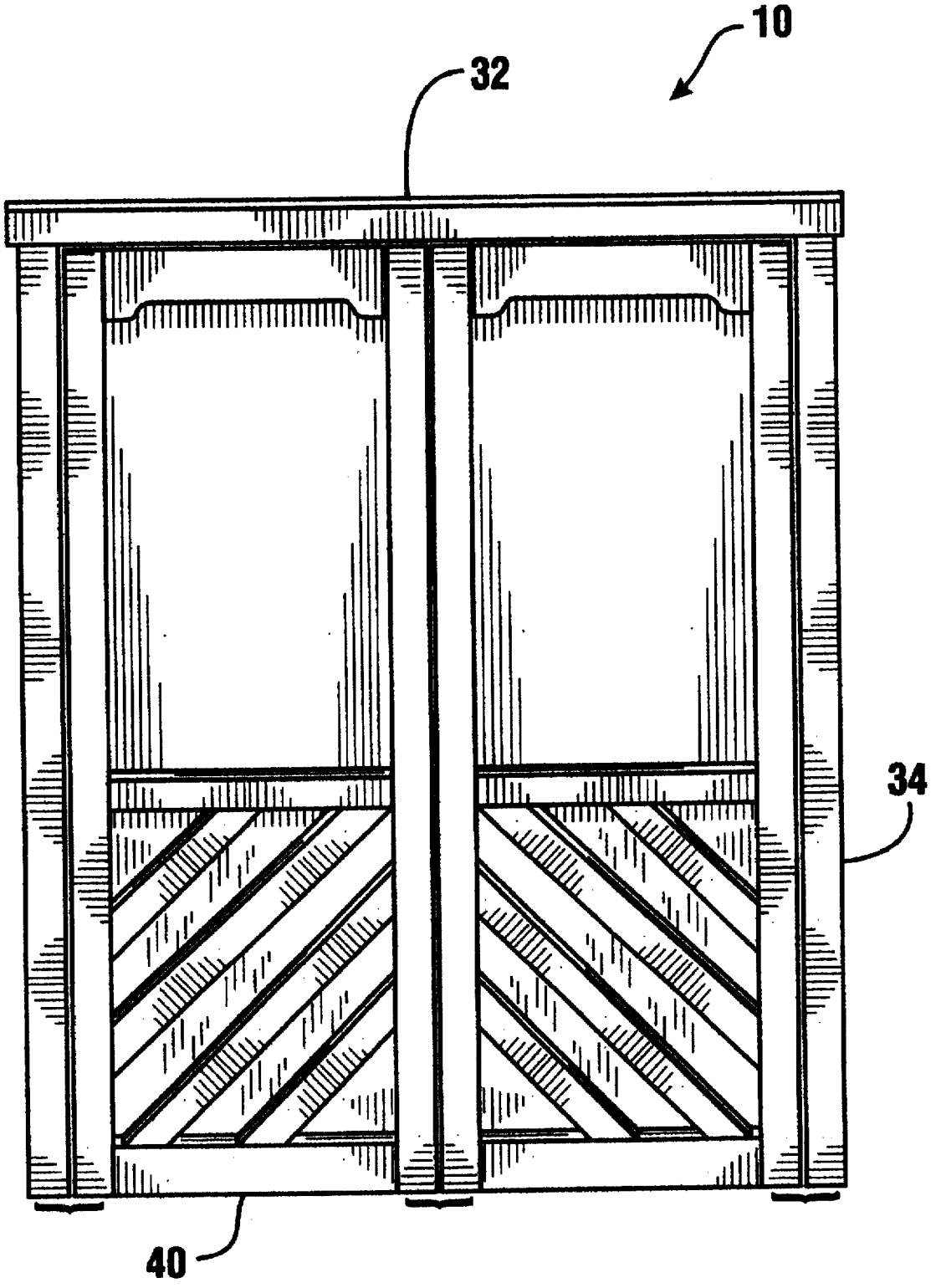
FIG. 1 is a front view of the door system showing the wood trim, door and wood braces.
Figure 2:
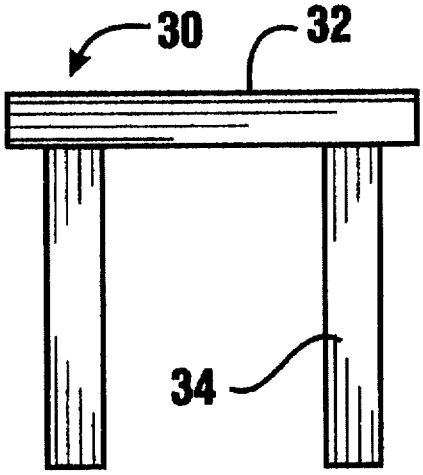
FIG. 2 is a front view of the wood trim

Referring now to the drawings and particularly to FIG. 1, there is shown therein a preferred embodiment of a wood door system of the present invention, generally indicated 10. Door system 10 is preferably used in connection with a rectangular wall opening in a wooden storage building with hinged dual movable doors. However, it should be understood that the present invention may be used with various wall opening shapes and movable door configurations. As shown in FIG. 2, wood trim 30 includes a generally horizontal top member 32 and side members 34.

Figure 3:
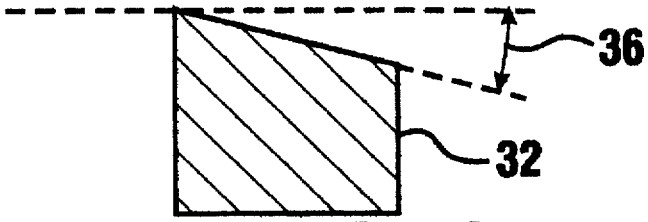
FIG. 3 is a cross-sectional view of a wood trim top member.

As shown in FIG. 3, wood trim top member 32 includes a top surface which is tapered outwardly and downwardly relative to the wall of the storage building. An angle 36 is formed between the outwardly and downwardly tapered top surface of wood trim member 32 and a projection of a top point of the top surface extending perpendicular to the wall of the wooden storage building. In the preferred form of the invention, angle 36 is approximately 12°. However, in other embodiments of the invention angle 36 may be increased or decreased so as to more readily shed various forms of precipitation or to tabor the angle to the variety of wood.

Figure 4:
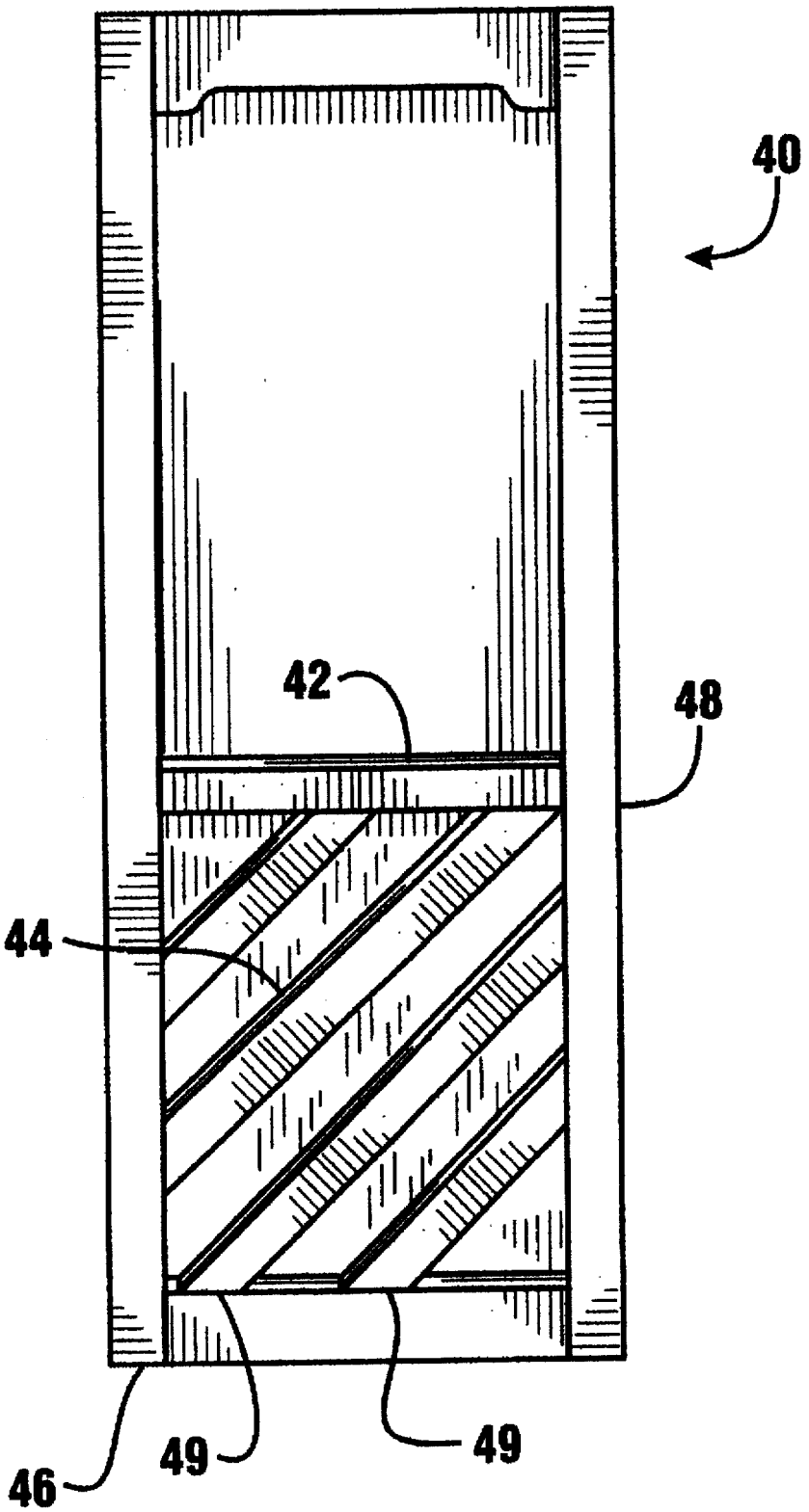
FIG. 4 is a front view of a door member.

As shown in FIG. 4, door 40 includes generally rectangular center brace member 42. Door 40 further includes a plurality of cross brace members 44 and a bottom brace member 46. Door 10 further includes a pair of generally vertically extending side members 48. Center brace member 42 extends generally horizontally between and engages side members 48. In the preferred form of the invention center brace member 42 is located approximately at the midpoint between a top edge and a bottom edge of door 40. Bottom brace member 46 is located adjacent the bottom edge of door 40 and extends generally horizontally between and engages side members 48. Cross brace members 44 are preferably located in uniformly spaced relation between center brace member 42 and bottom brace member 46, are oriented at approximately a 45° angle with such top and bottom brace members, and are located to abut at least two of center brace members 42, bottom brace member 46 and side members 48. As further shown in FIG. 4 the lower end of a cross brace member 44 which abuts bottom brace member 46 along a line of engagement 49. Cross brace member 44 is tapered inwardly and downwardly at a supplementary angle to the downwardly and outwardly tapered top surface of bottom brace member 46. In other embodiments of the invention such brace members may be placed at different locations and at different orientations on the door.

Figure 6:
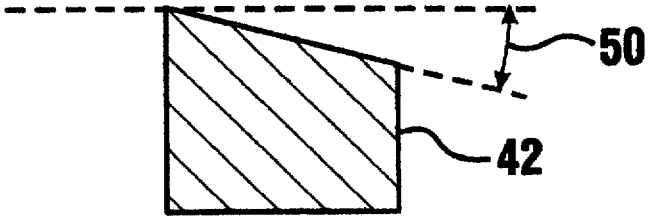
FIG. 6 is a cross-sectional view of a wood top brace member.
Figure 7:
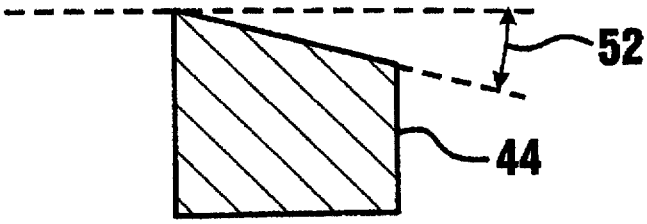
FIG. 7 is a cross-sectional view of a wood cross brace member.
Figure 8:
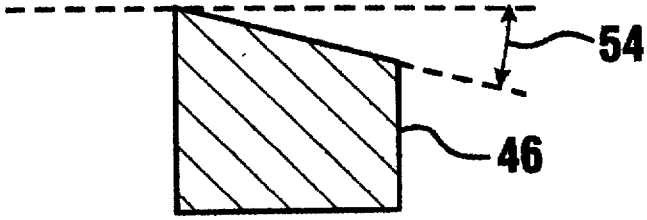
FIG. 8 is a cross-sectional view of a wood bottom brace member.
Figure 5:
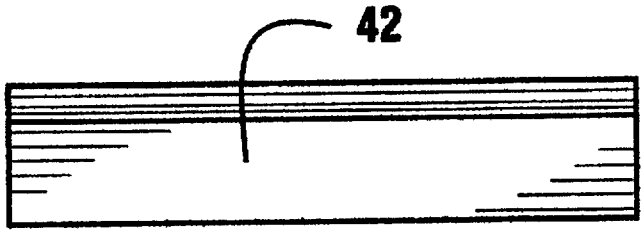
FIG. 5 is a front view of a wood brace.

As shown in FIGS. 6, 7 and 8, top brace member 42, cross brace members 44 and bottom brace member 46 include a top surface which is tapered outwardly and downwardly from the wall of the storage building. An angle 50 is formed between the outwardly and downwardly tapered top surface of top brace member 42 and a projection perpendicular to the wall of the wooden storage building. A similar angle 52 is formed by the top surface of cross brace member 44. Further, a similar angle 54 is formed by the top surface of bottom brace member 46. The angled top surfaces shed precipitation from rain or snow that falls thereon. The angled top surfaces further help to shed soot, dirt, dust and other contaminants that would otherwise collect thereon. This minimizes the risk that such materials will react with the water in the precipitation to attack or stain the wood or protective coating thereon. Such angles also keep the surface of the wood generally clean and dry. This lowers the amount of water penetration and mildew. It also minimizes cracking and warping and extends door life.

The tapered members provide support and bracing for the door to increase its strength in a manner similar to other types of wood bracing. The invention also provides an attractive appearance to the exterior of the door.

In the preferred form of the invention angles 50, 52, and 54 are approximately 12°. However, in other embodiments of the invention angles 50, 52 and 54 may be increased or decreased. The angles urge precipitation to fall from the top surfaces. The angles can be tailored to particular weather conditions or varieties of wood.

The embodiment of the invention shown is a hinged independently operably movable double door configuration with the cross brace members 44 on the fast movable door forming an angle of approximately 90° with the cross brace members 44 on the second movable door. It should be understood that the present invention may be used with other door types. The door may for example move by sliding the door directly in a track or channel or by rollers attached to the door, or by any other suitable means. Further, openings in storage building walls may be shaped other than rectangularly. Also, in other embodiments of the invention the braces may be placed at different locations and at different orientations on the door.

Thus the new door system of the present invention achieves the above stated objectives, eliminates difficulties encountered in the use of prior devices and systems, solves problems and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means capable of performing the recited function, and shall not be limited to the structures shown herein or mere equivalents.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

I claim:

1. A wood door system for outdoor storage buildings comprising:

a door, including:

an exterior wood door surface, whereby said door surface is exposed to weather in a closed position of said door; and a first wood brace member extending outwardly and in supported connection with said door surface, wherein said brace member includes a top surface bounding said brace member and wherein said top surface extends in a direction that is both downwardly and outwardly relative to said door surface.

2. The system according to claim 1 and wherein said first brace member is a generally rectangular member.

3. The system according to claim 1 wherein said first brace member extends generally horizontally.

4. The system according to claim 1 wherein said top surface of said first brace member also extends at an acute angle relative to a horizontal direction.

5. The system according to claim 1 wherein said system further comprises a second wood brace member extending outwardly and in supported connection with said door surface, and wherein said second brace member includes a second top surface bounding said second brace member and wherein said second top surface extends in a second direction, wherein said second direction extends both downwardly and outwardly with respect to said door surface, and wherein said first brace member extends generally horizontally, and wherein said second brace member extends at an acute angle relative to said first brace member.

6. The system according to claim 5 wherein said second top surface abuttingly engages said top surface along a line of engagement, and wherein said line of engagement extends downwardly and outwardly relative to said door surface.

7. The system according to claim 6 wherein said system comprises a plurality of said second brace members, each one of said second brace members abuttingly engaging said top surface of said first brace member.

8. The system according to claim 5 and further comprising a third wood brace member wherein said third wood brace member extends outwardly and in supported connection with said door surface, and wherein said third brace member includes a third top surface bounding said third member, and wherein said third top surface extends in a third direction, wherein said third direction extends both downwardly and outwardly relative to said door surface, and wherein said third brace member extends generally horizontally and wherein said third brace member is positioned vertically above said first brace member, and wherein said second brace member extends between said first and third brace members, and wherein said second top surface bounds said second brace member along an entire length of said second brace member between said first and third brace members.

9. The system according to claim 8 wherein said second brace member abuttingly engages both said first and third brace members, and wherein said second top surface of said second member abuttingly engages at least one of said first or third brace members.

10. The system according to claim 1 and further comprising a pair of generally vertically extending side members in operatively supporting connection with said door surface, and wherein said top surface of said first brace member extends continuously between said side members and wherein said top surface is in abutting relation with each of said members.

11. The system according to claim 8 and further comprising a pair of generally vertically extending side members in operatively supporting connection with said door surface, and wherein said first, second and third brace members extend between said side members and wherein said third top surface bounds said third brace member between said side members and wherein said third top surface abuttingly engages each of said side members.

12. The system according to claim 11 wherein said first, second and third brace members each abuttingly engage both of said side members.

13. The system according to claim 11 wherein said system comprises a plurality of said second brace members, each one of said second brace members abuttingly engaging one of said side members and said first brace member.

14. The system according to claim 11 wherein said system comprises a plurality of said second brace members, each one of said second brace members abuttingly engaging one of said side members and said third brace member.

15. The system according to claim 1 and further comprising a generally vertically extending building wall having an opening, and wherein said door surface is extendable into closing relation with said wall opening, and wherein said opening has a top trim member adjacent thereto, and wherein said top trim member includes an uppermost surface, wherein said uppermost surface extends in cross-section generally outwardly and downwardly relative to said building wall at all points in an outward direction from said building wall.

* * * * *